US011104533B2

(12) United States Patent
Fridolfsson et al.

(10) Patent No.: US 11,104,533 B2
(45) Date of Patent: Aug. 31, 2021

(54) CARTON STACK DIVIDER AND METHOD FOR DIVIDING A STACK

(71) Applicant: Norden Machinery AB, Kalmar (SE)

(72) Inventors: Pär Fridolfsson, Kalmar (SE); Peter Johnsson, Ljungbyholm (SE)

(73) Assignee: Norden Machinery AB, Kalmar (SE)

( * ) Notice: Subject to any disclaimer, the term of this patent is extended or adjusted under 35 U.S.C. 154(b) by 0 days.

(21) Appl. No.: 16/631,504

(22) PCT Filed: Jul. 12, 2018

(86) PCT No.: PCT/SE2018/050762

§ 371 (c)(1),
(2) Date: Jan. 16, 2020

(87) PCT Pub. No.: WO2019/017829

PCT Pub. Date: Jan. 24, 2019

(65) Prior Publication Data

US 2020/0172358 A1 Jun. 4, 2020

(30) Foreign Application Priority Data

Jul. 17, 2017 (SE) ..... 1750940-7

(51) Int. Cl.
*B65H 3/32* (2006.01)
*B65H 31/30* (2006.01)
*B65H 33/02* (2006.01)

(52) U.S. Cl.
CPC ..... *B65H 3/322* (2013.01); *B65H 31/3045* (2013.01); *B65H 33/02* (2013.01); *B65H 2301/4228* (2013.01)

(58) Field of Classification Search
CPC .... B65H 3/322; B65H 31/3045; B65H 33/02; B65H 2301/4228; B65H 2301/422;
(Continued)

(56) References Cited

U.S. PATENT DOCUMENTS 3,127,029 A 3/1964 Luginbühl
3,391,806 A * 7/1968 Geis ..... B65H 3/322 414/798.9

(Continued)

FOREIGN PATENT DOCUMENTS

GB 1199812 A 7/1970
GB 1387959 A 3/1975
WO 2012153255 A1 11/2012

OTHER PUBLICATIONS

International Search Report and Written Opinion dated Sep. 26, 2018 for PCT/SE2018/050762, 10 pages.

*Primary Examiner* — Gregory W Adams
(74) *Attorney, Agent, or Firm* — Sage Patent Group

(57) ABSTRACT

A divider for dividing a pack of flat-folded cartons into a plurality of stacks of flat-folded cartons, the divider comprising a magazine adapted to hold the carton pack, where the magazine includes a stop member, and where the divider includes a pusher member and a holder foot, where the magazine is arranged in an inclined position, where the pusher member is adapted to compress the carton pack between the pusher member and the stop member, where the holder foot is adapted to bear on the upper side of the compressed carton pack, and where the pusher member is adapted to release the pressure on the carton pack when the holder foot bears on the upper side of the carton pack, thereby creating a low density area adjacent a first carton stack.

11 Claims, 11 Drawing Sheets

(58) Field of Classification Search
CPC ..... B65H 2301/4223; B65H 2301/541; B65H 33/06; B65H 33/08; B65H 33/10; B65B 23/14; B65B 35/44; B65B 65/08; G06M 9/00; B26D 7/28; Y10S 414/115
See application file for complete search history.

(56) References Cited

U.S. PATENT DOCUMENTS 3,687,303 A * 8/1972 Kramer ..... B65H 3/322 414/796
3,826,348 A 7/1974 Preisig et al.
3,930,572 A * 1/1976 Fluck ..... B65B 23/14 198/367
3,996,667 A * 12/1976 Barnard ..... B65H 3/322 33/679.1
4,038,909 A * 8/1977 Preisig ..... B65H 33/02 198/418.8
4,054,020 A * 10/1977 Devilbiss ..... B65B 61/207 198/419.1
4,417,351 A * 11/1983 Williamson ..... G06M 9/00 33/679.1
4,785,731 A * 11/1988 Nguyen ..... B65B 13/20 100/4
4,869,359 A * 9/1989 Muller ..... G06M 9/00 198/419.2
5,095,684 A * 3/1992 Walker ..... B65B 57/12 198/462.2
5,102,293 A * 4/1992 Schneider ..... B65H 3/322 271/42
5,281,082 A * 1/1994 Ghilardi ..... B65H 31/32 414/798.9
6,502,052 B1 * 12/2002 Someya ..... G06M 9/00 702/128
6,860,091 B2 * 3/2005 Grano ..... A21C 15/04 53/157
7,470,102 B2 * 12/2008 Gendron ..... B65H 29/40 198/419.1
7,726,932 B2 * 6/2010 Leblanc ..... B65G 47/082 414/796
2006/0051195 A1 3/2006 Leblanc et al.
2010/0104413 A1 4/2010 Irwin
2012/0021887 A1 1/2012 Gelli et al.

* cited by examiner

CARTON STACK DIVIDER AND METHOD FOR DIVIDING A STACK

CROSS-REFERENCE TO RELATED APPLICATIONS

This application is a 35 U.S.C § 371 national stage application for PCT International Application No.: PCT/SE2018/050762, entitled "CARTON STACK DIVIDER AND METHOD FOR DIVIDING A STACK" filed on Jul. 12, 2018, which claims priority to Swedish Patent Application No. SE1750940-7 filed on Jul. 17, 2017, the disclosures and contents of which are hereby incorporated by reference in their entireties.

TECHNICAL FIELD

The present invention relates to a divider adapted to divide a pack of flat-folded cartons or carton blanks. The pack of flat-folded cartons is to be divided in several stacks of flat-folded cartons which may have a substantially equal size. The divider is to be used in the packing industry.

BACKGROUND ART

When articles are being packaged, it is often desirable to pack them either alone or together in separate packages. Thus, in highly automated packaging facilities, such articles may be transferred to cartons which are to serve as packaging for the article. These cartons are erected to form a final carton from flat-folded cartons prior to the packaging of the article in the carton. The flat-folded cartons are fed from a pick-up magazine to a conveyor by a feeding device. The feeding device picks up a flat-folded carton from the magazine, erects the carton and positions it in the conveyor. A flat-folded carton is made from a carton blank that is glued together at a side portion, such that the side walls of the carton are connected to each other.

A flat-folded carton can be erected in several different manners, and one of them involve picking up a flat-folded carton from a magazine above the feeding device and subsequently placing the erected carton in a position in a conveyor, where it in a subsequent position will receive the article. To reduce pressure on the lowermost flat-folded cartons, and to reduce the size of the feeding device, it is desirable to use magazines that do not hold too many flat-folded cartons.

The flat-folded cartons are loaded into these magazines in groups, comprising a number of flat-folded cartons. Such a group may consist of around 50 to 100 flat-folded cartons, such that there is always a flat-folded carton buffer in the magazine. Preferably, there are always a number of flat-folded cartons in the magazine in order to stabilize the stack of flat-folded cartons. At the same time, the number of flat-folded cartons in the magazine may not be too high, since the flat-folded cartons are not completely flat-folded and the stack of flat-folded cartons may twist and displace in the magazine. The loading of flat-folded cartons may be done by hand but it is often preferred to automate this process.

Thus, a loading machine will be used to load flat-folded cartons into the magazine. However, the flat-folded cartons are often delivered stacked next to each other in a manner most suitable for the economy of the transport of the flat-folded cartons. The flat-folded cartons may be placed onto carriers for transport to the magazine loading machine, also in a manner which is most efficient for the loading process. Thus the amount of stacked flat-folded cartons arriving at the loading station may not be the optimal amount of flat-folded cartons to be fed to the magazines or to be handled by the loading machine.

Since the amount of flat-folded cartons that arrive at the loading station may be more than what can be loaded into the magazine in one loading action, or that is optimal to handle, it is therefore desirable to divide the pack of flat-folded cartons into at least one appropriately sized stack to be loaded into the magazine.

U.S. Pat. No. 3,826,348 A discloses an article separation apparatus for selecting and separating flat-folded cartons. The apparatus comprises article selection means which bears on and moves over the edge of each article, which creates a slight depression of each article, opening up a small gap between the depressed article and the one preceding it. Once the apparatus decides that enough articles have passed the selection means, a separator or knife presses down on the article selection means and enters between the selected article and the one preceding it, allowing for the stack to be separated.

GB 1387959 A discloses an apparatus adapted to divide a stack of biscuits into batches of biscuits. A first plunger will bear on the edge of a single biscuit that will separate the remaining stack of biscuits from a batch of biscuits that is advanced downwards of a sloping support. A second plunger will bear on a part of the remaining stack of biscuits. GB 1199812 A discloses a similar apparatus adapted to divide a stack of biscuits into batches of biscuits.

DE 4208450 A1 discloses a device for moving a complete stack of folded boxes reliably from a magazine to a packing machine, where the folded boxes are delivered stacked in the magazine. Two linearly displaceable gripper arms of a gripper enter the magazine in cavities on opposing sides of the stack of boxes, and press the boxes together. The boxes may then be lifted up and out of the magazine, as they are held together by the pressure exerted by the gripper arms. The stack of boxes can then be moved into a suitable position or can be transferred to a conveyor belt.

While these solutions work well in certain situations, there is still room for improvements in order to achieve a unit which allows for separation of a stack of flat-folded cartons from the remaining pack of flat-folded cartons and preparing them to be transferred to a magazine.

DISCLOSURE OF INVENTION

An object of the invention is to provide an improved divider for dividing a pack of objects, such as e.g. flat-folded cartons or carton blanks. A further object of the invention is to provide an improved method for dividing a pack of flat-folded cartons or carton blanks.

The solution to the problem according to the invention is described in the characterizing part of claim 1 regarding the divider and in claim 12 regarding the method. The other claims contain advantageous further developments of the divider.

In a divider for dividing a pack of flat-folded cartons into a plurality of stacks of flat-folded cartons, where the divider comprises a magazine adapted to hold the carton pack, where the magazine comprises a stop member, where the magazine is arranged in an inclined position, and where the divider comprises a pusher member and a holder foot, the object of the invention is achieved in that the pusher member is adapted to compress the carton pack between the pusher member and the stop member, where the holder foot is adapted to bear on a first side of the compressed carton pack, and where the pusher member is adapted to release the pressure on the carton pack when the holder foot bears on the upper side of the carton pack, thereby creating a low density area adjacent the first carton stack.

By this first embodiment of a divider according to the invention, a divider that can divide a pack of flat cartons into two or more stacks is provided, such that a stack of flat cartons of a desired size can be obtained. The magazine holding the carton pack is arranged in an inclined position. The inclined position may either be permanently inclined or may be obtained by tilting the magazine with the carton pack from a horizontal position to the inclined position. The divider may for this reason comprise a tiltable table adapted to incline the magazine.

The carton pack is compressed, either before or after the magazine is arranged in the inclined position. An advantage of compressing the carton pack is to be able to measure the length of the carton pack. Another advantage is to align the flat-folded cartons in the carton pack, since they may be arranged in a somewhat angled way. By aligning the carton pack, the dividing into a carton stack is simplified. A further advantage of compressing the carton pack is that there will be room for a low density area in the magazine.

One problem that occurs with flat-folded cartons is that they will try to unfold somewhat when the pressure on a carton pack is released. The natural shape of a flat-folded carton is a somewhat rhombic shape, since there is some tension in the corners of a flat-folded carton. It is thus of advantage to hold the carton pack in a compressed state. When the pressure on a compressed pack of folded cartons is released completely, the pack will expand as much as it is allowed, which at the same time causes the folded cartons to misalign. It is thus important that a pack of folded cartons is handled in a compressed state. The amount of compression may vary, but in a compressed pack, the folded cartons are substantially flat, and the distance between two folded cartons is in the region of 1.1 to 1.2 times the width of a folded carton or less. In the low density area, the distance between two folded cartons may be in the region of 1.5 times the width of a folded carton or more.

When the carton pack is compressed and positioned in the inclined position, a holder foot is lowered to bear on a first side of the carton pack. The first side is preferably the upper side of the carton pack, but it is also possible to arrange the holder foot such that it bears on the underside of the carton pack. In the shown example, the upper side of the carton pack will constitute the first side of the carton pack. The holder foot is arranged at a parting plane and will support all cartons above the holder foot. When the holder foot bears on the upper side of the carton pack, which will constitute the first stack of flat-folded cartons, the pusher member retracts and releases the pressure on the remaining carton pack. The flat-folded cartons not supported by the holder foot will now move downwards towards the lower part of the magazine, while the flat-folded cartons supported by the holder foot will remain at the upper part of the magazine. The flat-folded cartons that are supported by the holder foot will constitute the first stack of flat-folded cartons. A low density area has now been created at the parting plane, adjacent the first stack of flat-folded cartons. In the low density area, the distance between two flat-folded cartons is larger than in the first stack of cartons, since the flat-folded cartons are allowed to unfold somewhat. The density in the remaining carton pack will vary over the length of the carton pack, with the lowest density at the upper end of the pack, adjacent the first stack, due to gravity.

The size of the created stack may be of any desired size, and may refer to either the length of the stack or the number of flat-folded cartons in the stack. One purpose of the invention is to create stacks of flat-folded cartons or the like having a substantially equal number of cartons, and to allow a pack of flat-folded cartons to be divided into several stacks of flat-folded cartons in a reliable way, such that a well-defined stack can be picked up by e.g. a gripping device without a flat-folded carton being halfway between the stack and the remaining pack of cartons. The pack of cartons will have a predefined number of cartons, but this number may differ some depending e.g. on allowed tolerances. The created stack can be transported, moved or forwarded towards another work station.

In one development of the invention, a parting tip is inserted into the low density area. The reason for creating a low density area is to make sure that the parting tip can enter between two flat-folded cartons. In a compressed pack of cartons, the likelihood that the parting tip will hit an edge of a flat-folded carton is relatively large. By creating a low density area for the parting tip, this likelihood is minimised and may be totally removed. The parting tip comprises parting fingers that can be extended rearwards or forwards from the parting tip, which will create a well-defined gap between the stack of flat-folded cartons and the remaining cartons in the carton pack. In the shown example, the parting fingers will extend forwards from the parting tip. At the same time, the holder foot is raised from the upper side of the stack by moving it upwards towards the resting position. By separating the first stack from the remaining carton pack by the use of a parting finger, a more reliable and well-defined gap is created between the first stack and the remaining carton pack. This will simplify the pick-up of the first stack by a gripping device.

In one development of the invention, the divider comprises a support finger which is adapted to be inserted between the first stack and the remaining carton pack. The support finger may be inserted directly in the low density area adjacent the first stack, or may be inserted into the gap created by the parting tip and the parting finger. The support finger will support the rear of the first stack when a gripping device picks up the stack. In this way, the parting tip can be moved away from the carton pack before the first stack is picked up by a gripping device, which will simplify the removal of the first stack. The support finger will further support the front of the remaining carton pack when it is pushed forwards towards the stop members, such that the position of the flat-folded cartons is preserved.

A pusher member is provided with a sensor that is adapted to measure a value that corresponds to the travel distance of the pusher member. By using this value, the length of the compressed carton pack can be estimated. The resting position for the pusher member is in its most retracted position at the rear end of the magazine. The pusher member will extend forwards and will compress the carton pack until a predefined compression is reached. The compression value can be detected either by a pressure sensor or by detecting the drive current to a drive motor used to power the pusher member. By measuring the travelled distance at the same time, a value that can be used to estimate the length of the compressed carton pack is obtained. From this value, the number of flat-folded cartons in the carton pack can be determined.

The carton pack preferably contains a predefined number of flat-folded cartons, e.g. 520. In the shown example, three stacks will be created from the carton pack. The holder foot is thus positioned at a position where it will bear on the end of the first stack, such that approximately 173 flat-folded cartons will be in the first stack. This number does not have to be exact, but should be approximately a third of the carton pack. Depending on the tolerances of the gripper device that will collect the stack, a stack may comprise e.g. between 160-180 flat-folded cartons.

However, depending on the production site producing the carton packs, the number of flat-folded cartons in a carton pack may vary between e.g. 500-550 flat-folded cartons. The pusher member can thus be arranged to retract somewhat when the number of flat-folded cartons in the carton pack has been determined, such that the first stack will contain approximately a third of the flat-folded cartons.

When the number of flat-folded cartons in the carton pack has been determined, it is also possible to determine if the number of flat-folded cartons in the carton pack is within a predefined range. If it is determined that the number of flat-folded cartons in the carton pack is above or below the predefined allowed range, the complete carton pack can be discarded and a new carton pack can be collected to the magazine.

In one development, the divider is provided with a sensor that detects the position of the parting tip. In this way, it is possible to detect if the parting tip has been able to fall down into the low density area, or if the tip is stuck on a damaged carton or on a carton that is angled or misplaced, which will prevent the parting tip from entering the low density area. Since the parting tip is arranged on a pivotable parting arm, the parting tip will enter the low density area only if there is nothing in the way for the parting tip. It is also possible that the parting tip is caught directly on a single carton that is positioned somewhat oblique or that is warped. This is detected by the sensor. In one example, it is possible to repeat the dividing of the carton pack by raising the parting tip and the holder foot, compressing the carton pack again and to lower the holder foot onto the upper side of the carton pack, and to retract the pusher member once more, such that a new try is made to divide the pack. If this try does not succeed, an error message may be given. It is also possible to give an error message right away. By detecting if the pack was divided successfully, it can be ensured that the gripping device will be able to grip a proper stack of cartons. If a gripping device tries to grip a stack that is not divided in a successful way, one or more cartons may be damaged and the production line may have to stop.

In one example, the holder foot is mounted on a first linear actuator adapted to move the holder foot from a position spaced-apart from the carton pack, i.e. a position above or below the carton pack, to a position in which the holder foot bears on a first side, i.e. an upper side or lower side, of the carton pack. The parting device comprising the parting arm with the parting tip is mounted on a second linear actuator adapted to move the parting device from an upper position above the carton pack to a position in which the parting device bears on the carton pack, such that the parting tip can enter the low density area. By positioning the holder foot and the parting device well above the position of the pack in the idle state, removal of a stack from the divider and feeding of a pack to the divider is simplified. A support finger may be mounted on a third linear actuator, which is adapted to move the support finger from an upper position above the carton pack to a lower position in which the support finger is positioned between the first stack and the remaining carton pack.

In a method for dividing a pack of flat cartons, using a divider, the steps of: arranging a magazine comprising a carton pack in an inclined position, compressing the carton pack with a pusher member, moving a holder foot from a position spaced-apart from the carton stack to a position in which the holder foot bears on a first side of the carton stack, and releasing the pressure of the pusher member by retracting the pusher member, where the flat-folded cartons held by the holder foot constitute a first stack, and where the remaining carton pack held by the pusher member is allowed to move downwards, thereby creating a low density area adjacent the first stack are comprised.

By the inventive method, a pack of flat cartons can be divided into two or more stacks of carton blanks in a reliable way. By arranging the carton pack in an inclined position and by compressing the carton pack, a stack of flat-folded cartons can be created in an easy and reliable way by holding the stack of flat-folded cartons by a holder foot and releasing the remaining carton pack downwards. This will create a low density area or a void adjacent the stack of cartons held by the holder foot by gravity. The size of the void will depend on how much the pusher member is retracted and on how much the flat-folded cartons expand when the pressure is released.

A parting tip may enter the low density area by gravity. This will ensure that a stack is separated in a reliable way, and that there is no carton being caught in the low density area between the first stack and the remaining carton pack.

The method may further comprise the step of creating a well-defined gap between the first stack and the remaining carton pack by extending a parting finger from the parting tip. A parting finger, or one parting finger on each side of the parting tip, is extended forwards or rearwards, pushing the cartons away from the parting tip. This will create a well-defined gap between the first stack and the remaining carton pack, which will simplify the pick-up of the first stack by a gripping device. It is also possible to insert a support finger into the well-defined gap between the first stack and the remaining carton pack. With the support finger in place, the holder foot and the parting tip can be removed, which may further simplify the pick-up of a stack of cartons.

BRIEF DESCRIPTION OF DRAWINGS

The invention will be described in greater detail in the following, with reference to the embodiments that are shown in the attached drawings, in which.

MODES FOR CARRYING OUT THE INVENTION

The embodiments of the invention with further developments described in the following are to be regarded only as examples and are in no way to limit the scope of the protection provided by the patent claims. The use of directional specifications, such as front, rear, up, down, forwards, etc., refers to the orientation of the divider in use and to the pack of cartons.

Figure 1:
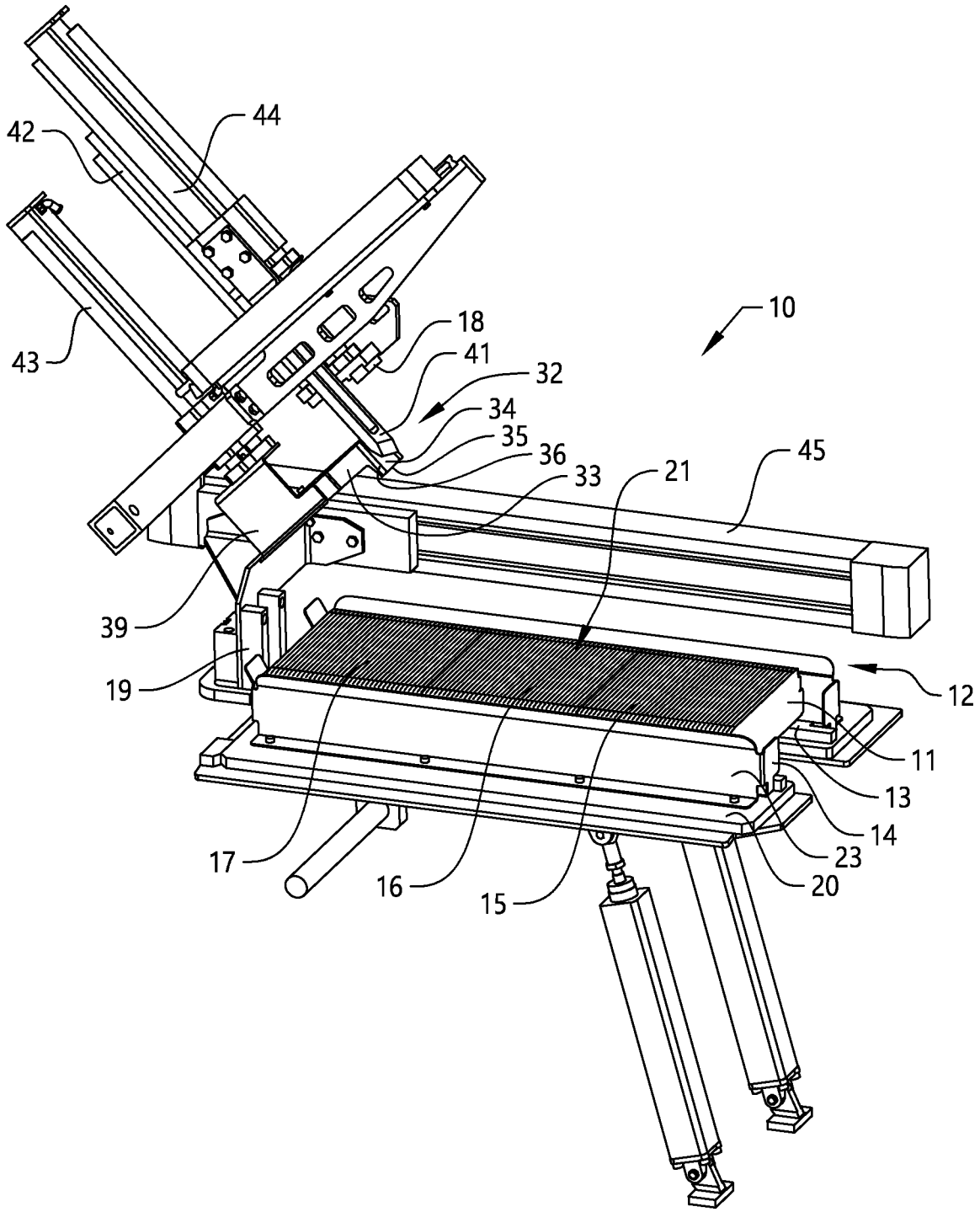
FIG. 1 shows a divider according to the invention with a magazine in a horizontal position.

The divider 10 according to the invention comprises a tiltable table 20 adapted to support a magazine 23, a pusher member 19 and a holder foot 18. The divider is adapted for dividing a carton pack 12 of flat-folded cartons 11 which in the described example is fed to the divider in a horizontal orientation. It is however possible to feed the pack of flat-folded cartons to the magazine in another orientation. In the described example, the divider also comprises a parting tip 34 and a support finger 41. FIG. 1 shows a perspective view of a divider 10 with a magazine in a horizontal position before the dividing of the carton pack has started. Here, the tiltable table 20 is in a horizontal position and the pusher member 19 is in a retracted position. A pack of cartons 12 is positioned in the magazine. The carton pack may be fed to the divider by replacing an empty magazine with a full magazine, or the carton pack may be placed in the magazine by a feeder device. A pack of cartons may correspond to e.g. two to four carton stacks. The carton pack 12 is arranged on a carton plane 13 in the magazine and is supported by stop members 14 at the front of the magazine. The pusher member 19 comprises in this example two pusher arms and is adapted to compress the carton pack 12. The magazine may also be permanently arranged in an inclined position.

In the shown example, the holder foot 18 is mounted on a first linear actuator 42 adapted to move the holder foot from a position spaced-apart from the carton pack to a position in which the holder foot bears on a first side 21 of the carton pack 12. The first side may be the upper side or the lower side of the carton pack. In the shown example, the holder foot is arranged in a position above the carton pack, but it is possible to arrange the holder foot in a position below the carton pack. A parting device 32 comprising a parting arm 33 with a parting tip 34 is mounted on a second linear actuator 43 adapted to move the parting device from an upper position above the carton pack to a lower position in which the parting device bears on the upper side of the carton pack. The support finger 41 is mounted on a third linear actuator 44, which is adapted to move the support finger from an upper position above the carton pack to a lower position in which the support finger is positioned between the first stack and the remaining carton pack. The linear actuators may e.g. be air actuators or electrical actuators. A typical example of a carton pack may comprise 520 flat-folded cartons and is to be divided into three carton stacks, comprising approximately the same number of flat-folded cartons. In this example, the three carton stacks that are to be divided from the carton pack are the first carton stack 15, the second carton stack 16 and the third carton stack 17.

Figure 2:
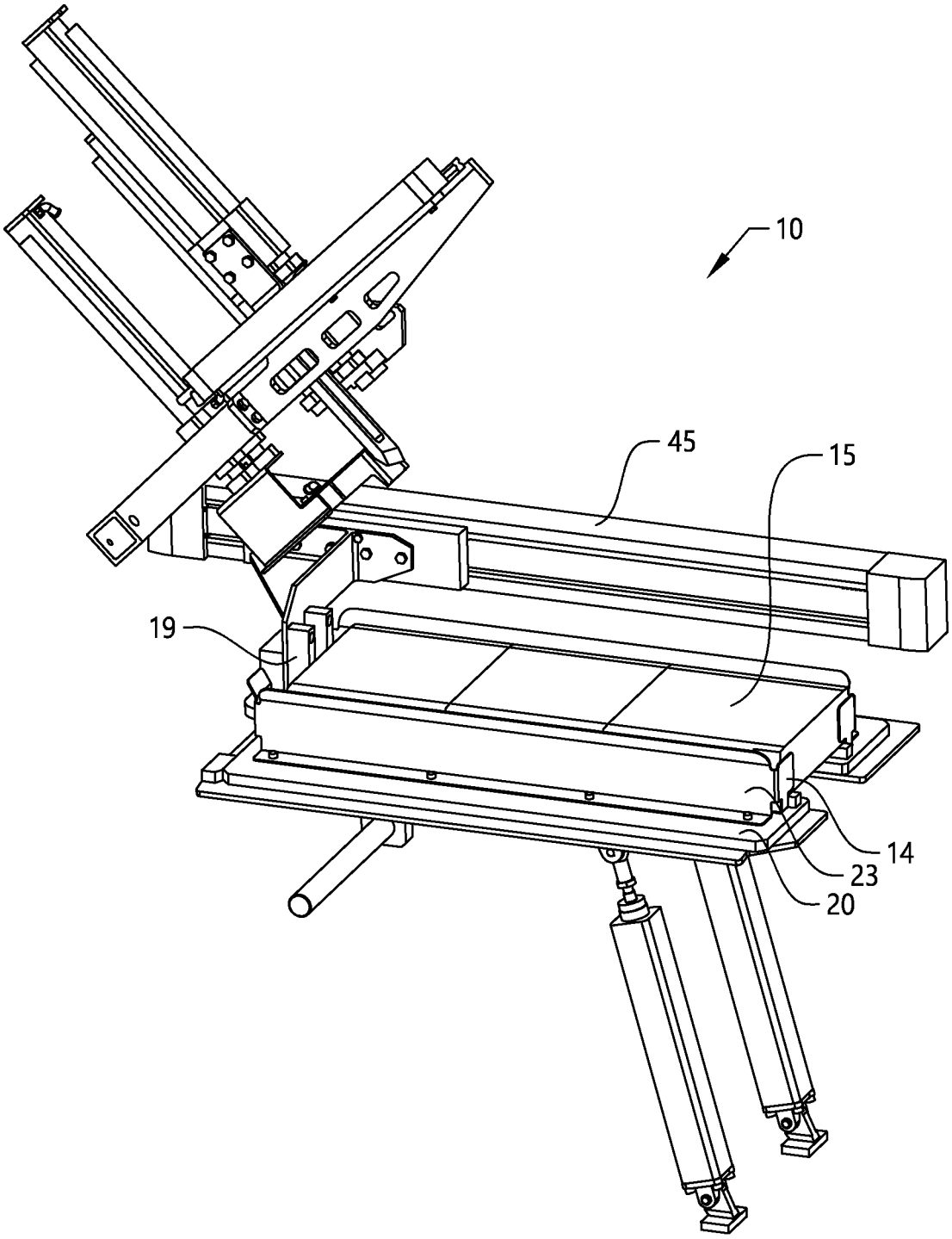
FIG. 2 shows a divider according to the invention with an extended pusher member.

In FIG. 2, the pusher member 19 has compressed the carton pack 12 by extending the pusher member 19 from the idle position to a position in which the carton pack is compressed to a predefined extent. The idle position for the pusher member is in its most retracted position at the rear end of the magazine 23. The pusher member 19 will extend forwards by e.g. a drive motor or a linear actuator and will compress the carton pack until a predefined compression is reached. In the shown example, the pusher member 19 is mounted to a fourth linear actuator 45 and is here an electrical actuator that uses an electrical rotary motor for the movement of the pusher member. The compression value can be detected e.g. by a pressure sensor or by detecting the drive current to the drive motor. During the compression, the travelled distance of the pusher member is measured at the same time, e.g. by the use of a decoder measuring the rotation of the drive motor or by a linear encoder. In this way, a measure which can be used to estimate the length of the compressed carton pack is obtained. From this value, the number of flat-folded cartons in the carton pack can be determined.

The carton pack preferably contains a predefined number of flat-folded cartons, in the shown example 520 cartons, and three stacks will be created from the carton pack. It is preferred that the created stacks are more or less equal in size. In this example, each stack will thus contain approximately 173 flat-folded cartons, which can be seen as a nominal value for a carton stack. The carton stacks do not have to be exactly the same size, but should be approximately a third of the carton pack. Depending on the tolerances of the gripper device that will collect the stack, a stack may comprise e.g. between 160-180 flat-folded cartons.

The size of a pack of flat-folded cartons may vary, depending on how a carton pack is assembled at the production site producing the carton packs. The number of flat-folded cartons in a carton pack may vary between e.g. 500-550 flat-folded cartons. The allowed range for a carton pack may be e.g. 500-540 flat-folded cartons. By determining the number of flat-folded cartons in a carton pack, it is also possible to determine if the number of flat-folded cartons in the carton pack is within the allowed range. If it is determined that the number of flat-folded cartons in the carton pack is above or below the allowed range, the complete carton pack can be discarded and a new carton pack can be collected to the magazine.

If the number of flat-folded cartons is within the allowed range, the size of the carton pack is used to determine the size of the stacks that are to be created.

The size of the carton pack is divided by three. The holder foot is in the shown example positioned at a fixed position that corresponds to a nominal carton stack size. The position of the holder foot may be adapted to either a nominal carton pack or to the largest allowed carton pack. This fixed position will give three equal stacks from the carton pack. If the size of the carton pack differs from this size, the pusher member is arranged to retract somewhat in order to make sure that the first stack will contain approximately a third of the flat-folded cartons. It is also possible to let the pusher member retract somewhat every time, either by a predefined value or in dependency of the estimated number of cartons in the carton pack.

Figure 3:
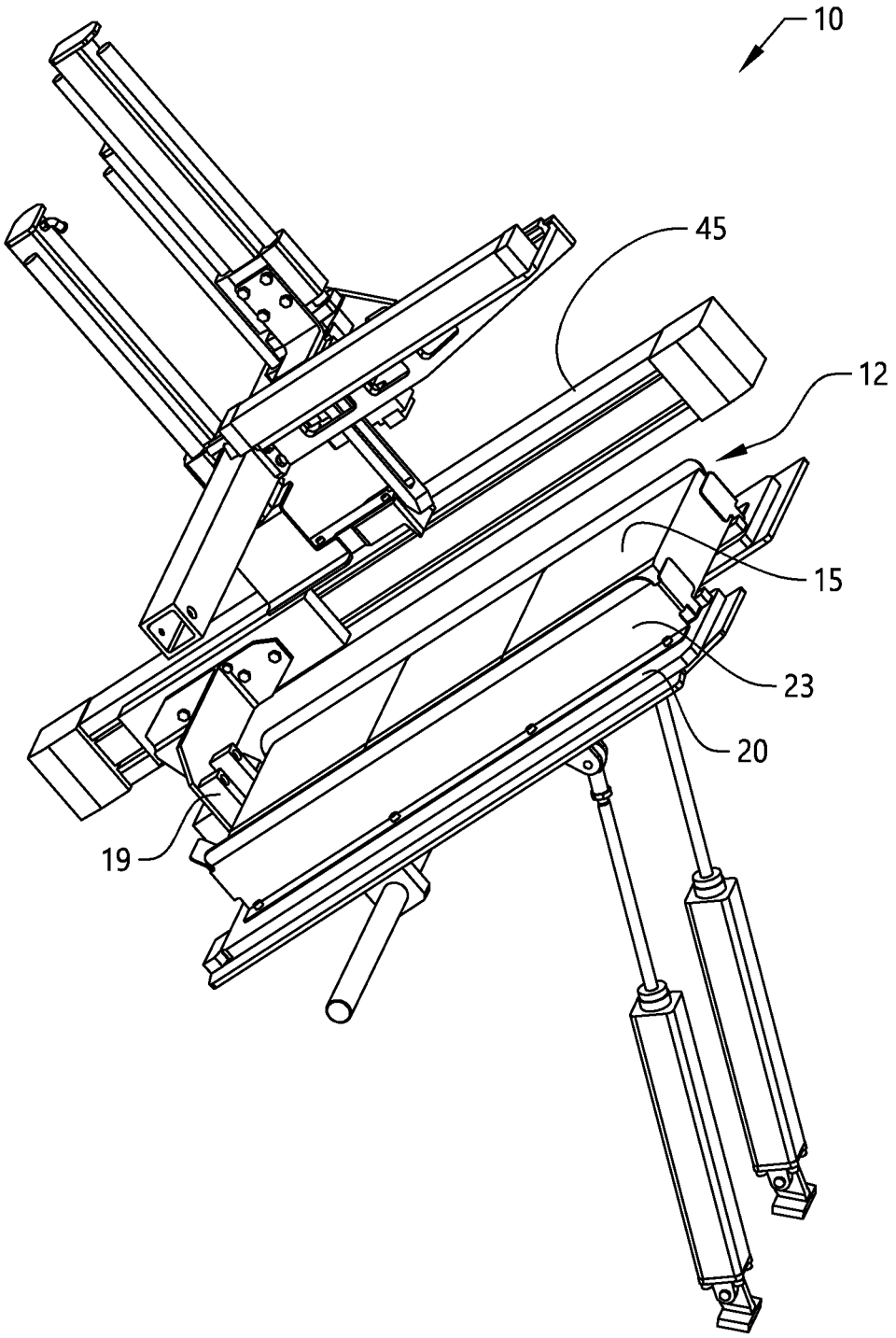
FIG. 3 shows a divider according to the invention with an inclined magazine.

In FIG. 3, the tiltable table 20 with the magazine 23 has been raised to an inclined position. It is also possible to permanently arrange the table in an inclined position. The inclined position is preferably in the range between 30 to 70 degrees relative the horizontal plane, and more preferably in the range between 45 to 60 degrees. With such an inclination, the flat-folded cartons will remain in the magazine without falling out and will also be able to easily slide down in the magazine by gravity when the pusher member is retracted. It would be possible to incline the table by 90 degrees, but this will require support means to hold the flat-folded cartons in the magazine.

Figure 4:
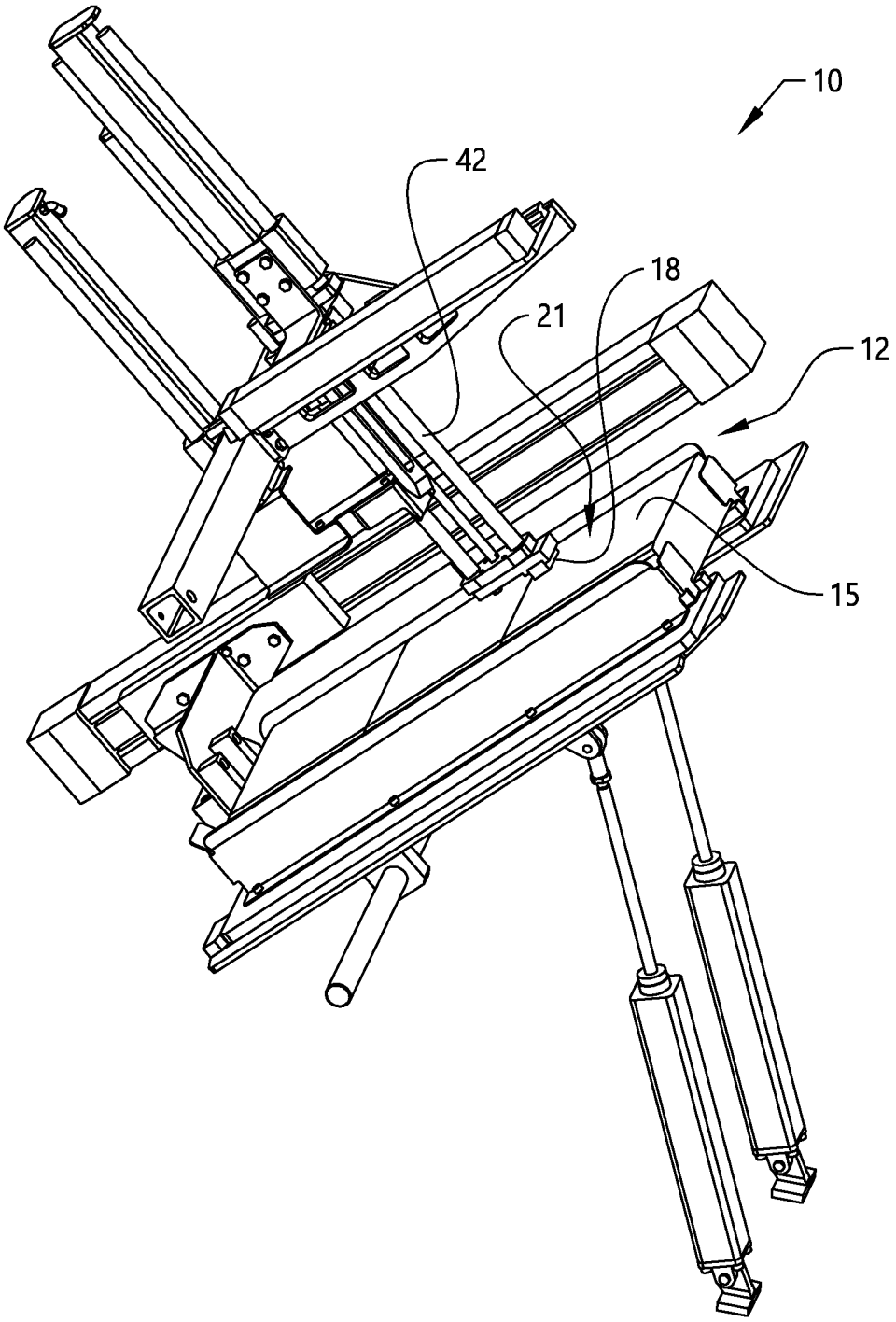
FIG. 4 shows a divider according to the invention with a lowered holder foot.

In FIG. 4, the holder foot 18 has been lowered and bears on the upper side 21 of a plurality of flat-folded cartons 11 in the carton pack 12, e.g. on 3-10 flat-folded cartons. The holder foot is provided with a friction material, e.g. rubber or plastic that will secure a firm hold of the flat-folded cartons and at the same time make sure that the cartons are not damaged. The holder foot will hold the rearmost flat-folded cartons of the first stack 15.

Figure 5A:
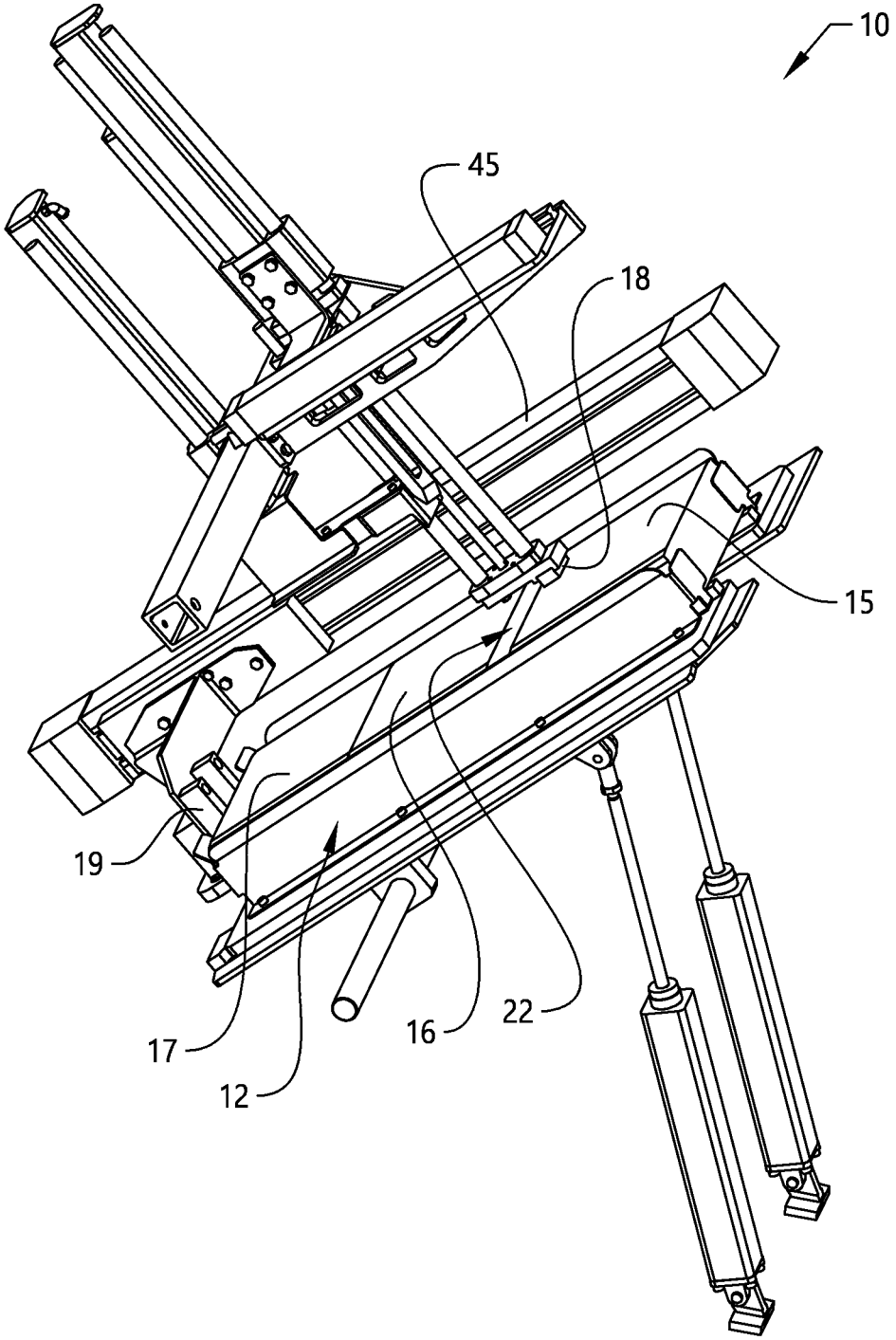
FIG. 5*a* shows a divider according to the invention when a carton pack is being divided.
Figure 5B:
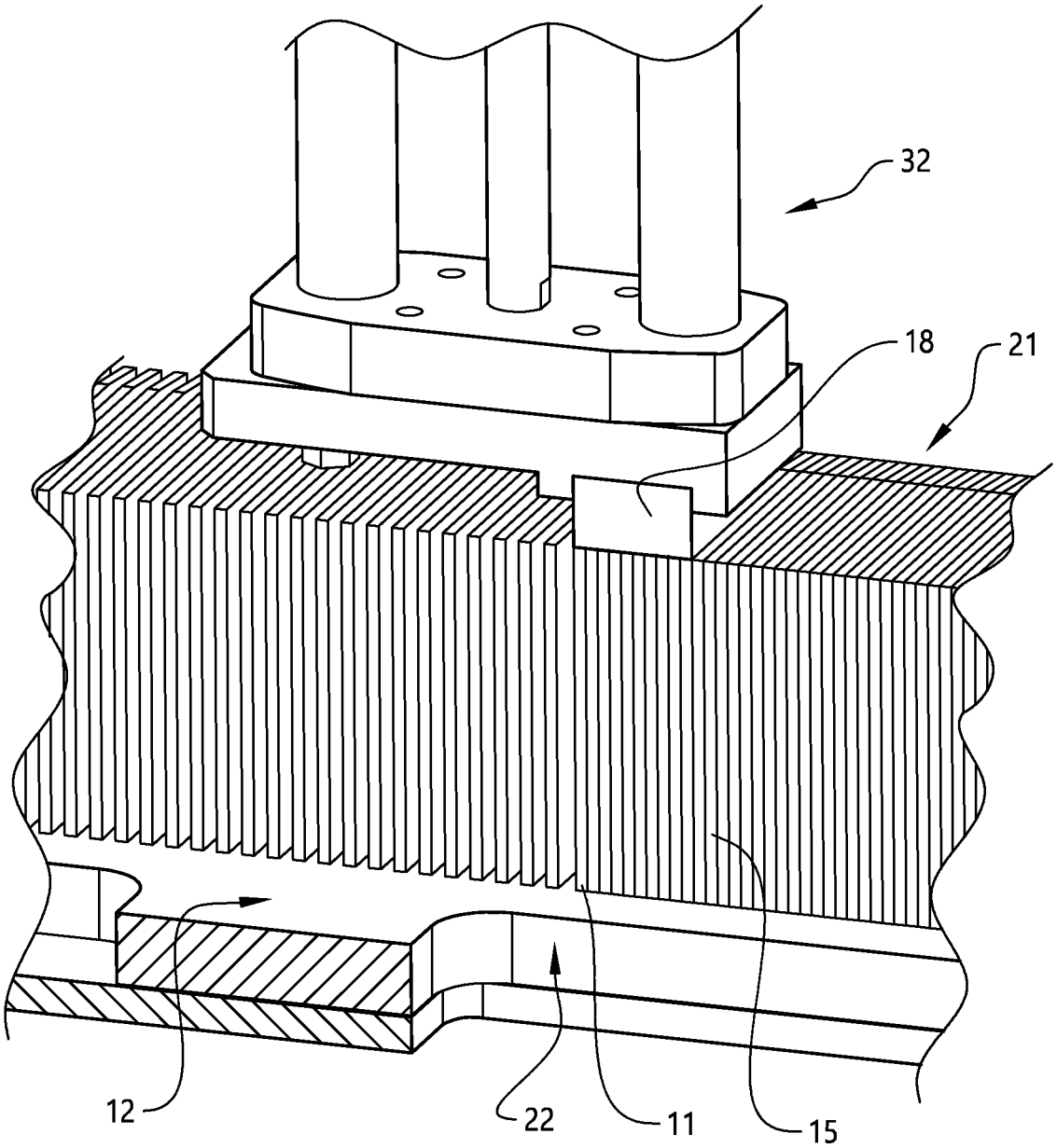
FIG. 5*b* shows a detail of FIG. 5*a*.

In FIG. 5*a,* the pusher member 19 has been retracted somewhat. The pusher member may retract to the idle position or to an intermediate position in which a sufficiently large low density area 22 or even a void is created adjacent the first stack. When the pusher member is retracted, the compression of the remaining carton pack will be lowered and the carton pack will follow the pusher member downwards. When the pressure on the flat-folded cartons in the remaining carton pack is released, the flat-folded cartons may expand some. This will lower the density of flat-folded cartons in the remaining carton pack and especially at the upper region of the remaining carton pack, and may even create a void between the first carton stack and the remaining carton pack. The flat-folded cartons in the first carton stack held by the holder foot will remain compressed. A first stack of flat-folded cartons has now been created. The first stack can be gripped by a gripping device. FIG. 5*b* shows a detail of FIG. 5*a,* where the difference in density between the compressed first carton stack 15 held by the holder foot 18 and the remaining carton pack is visible. The carton density in the remaining carton pack will vary some over the length of the remaining carton pack, with the lowest carton density at the upper part, close to the first carton stack. The area closest to the first carton stack is referred to as the low density area 22.

Figure 6A:
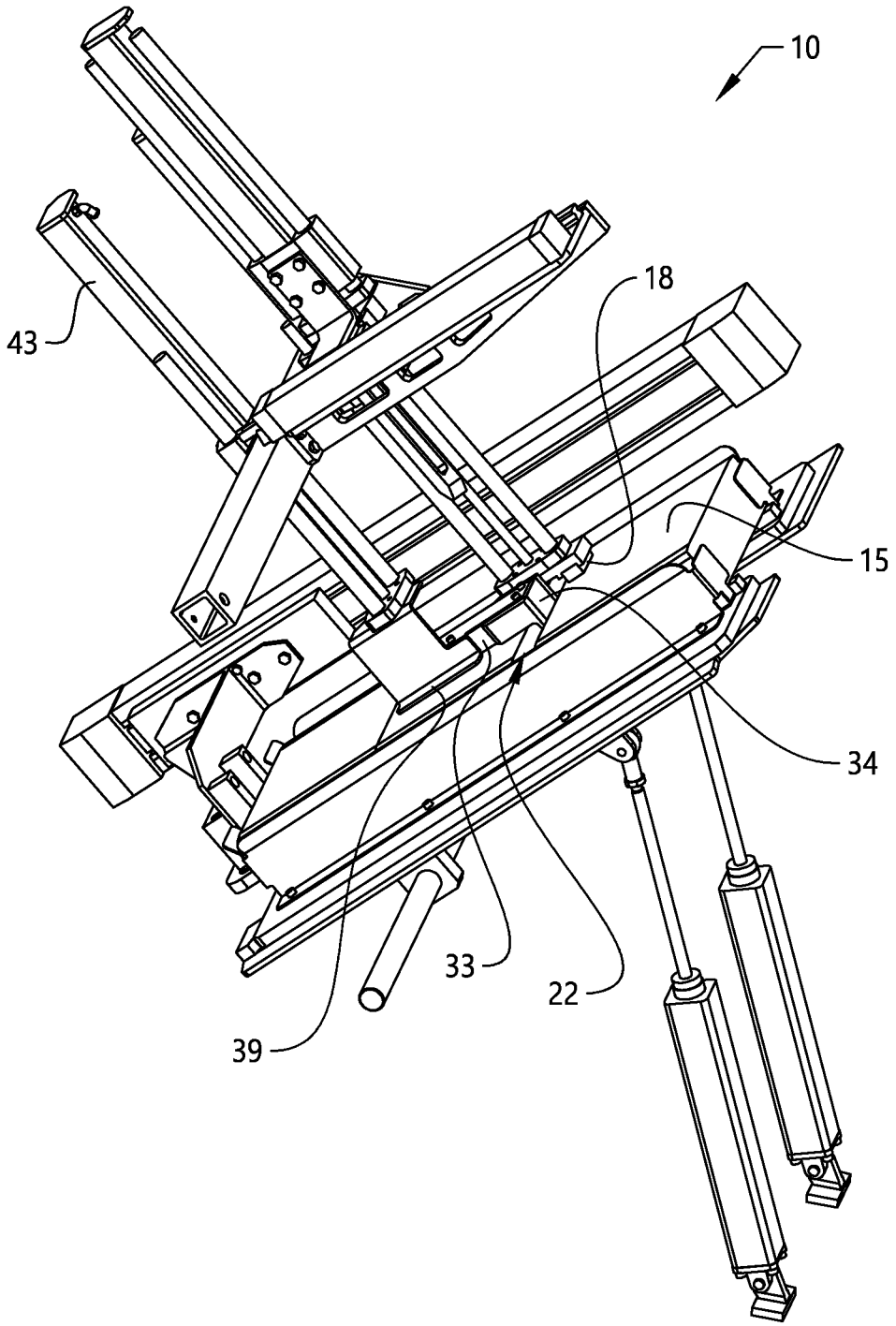
FIG. 6*a* shows a divided pack where a parting tip has entered the low density area.
Figure 6B:
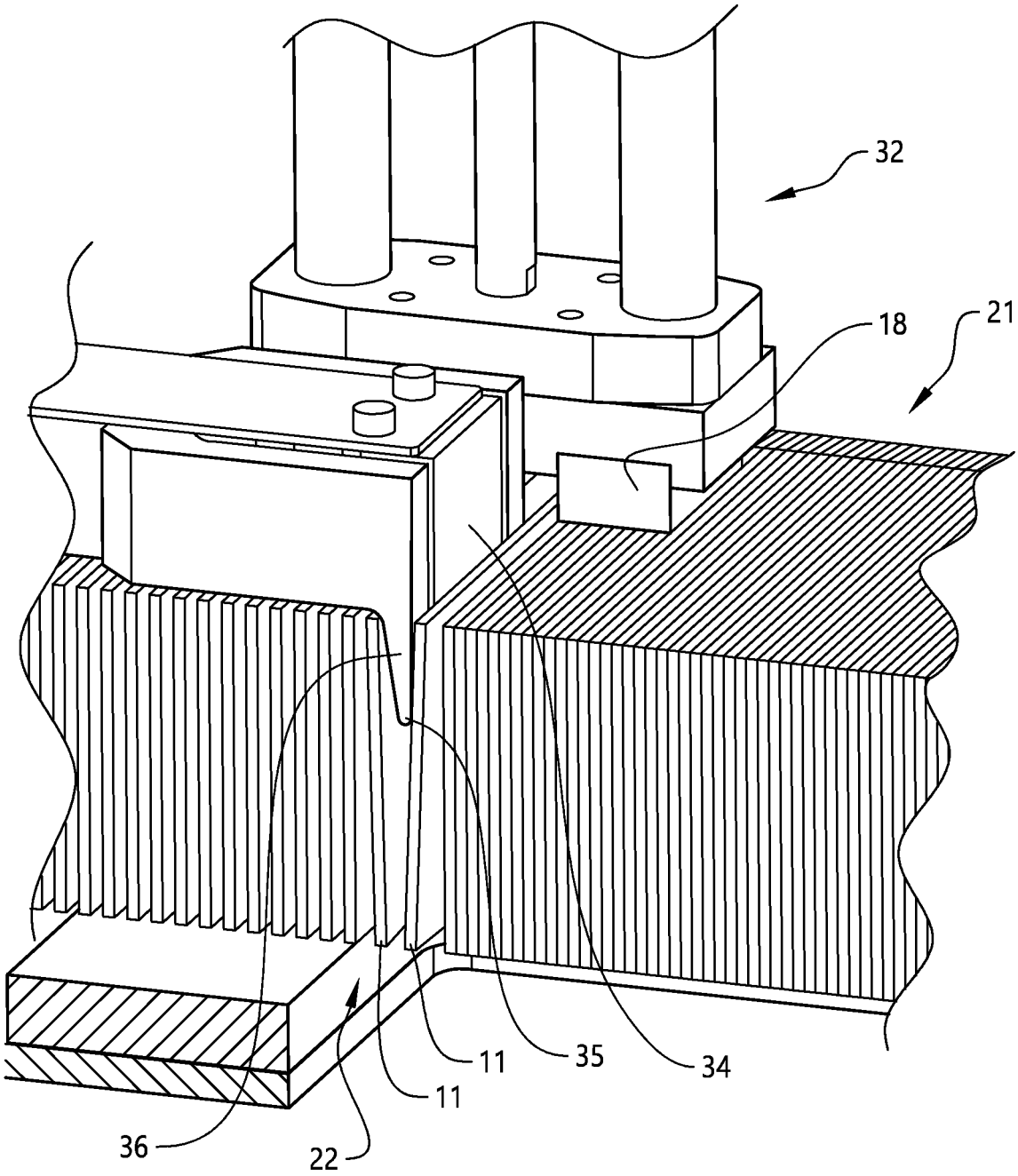
FIG. 6*b* shows a detail of FIG. 6*a*.

In the shown example, a parting tip is inserted into the low density area in order to make sure that there is no misaligned carton in the low density area and to obtain a well-defined gap between the first stack and the remaining carton pack. The reduced density in the low density area will allow the parting tip 34 to fall down between two flat-folded cartons 11. In FIG. 6*a,* the parting device 32 has been lowered and bears on the remaining carton pack. The parting device comprises a parting arm 33 having a parting tip 34 with a parting edge 35. The parting tip 34 has entered the low density area successfully. FIG. 6*b* shows a detail of FIG. 6*a,* where the parting tip 34 can be seen between two flat-folded cartons 11 in the low density area 22. When the parting tip has entered the low density area, the holder foot will be raised from the lower position to its idle position.

The parting tip 34 is arranged on the parting arm 33 which is suspended at a rear end of the parting device 32 at a pivot axle. The pivot axle is mounted to a bracket 39 which is mounted to the second linear actuator 43. The bracket is provided with a sensor which is adapted to detect the position of the parting arm and thus the parting tip. The parting arm is provided with a detection plate. The position of the detection plate can be detected by the sensor. The sensor may e.g. be a magnetic sensor or an optical fork coupler or reflex coupler. The sensor detects when the arm and thus the tip is in a raised position or when the parting tip has entered the low density area. The parting edge 35 of the parting tip 34 is pointed with a relatively small radius, but is not sharp. The shown parting tip further comprises two parting fingers 36 arranged on both sides of the parting edge 35. The parting fingers can be extended rearwards or forwards from the parting tip by the use of an actuator integrated in the parting arm. The parting tip and the parting fingers are relatively thin, and are preferably one or a few millimetres thick.

When the parting device 20 is lowered by the second linear actuator 43, the parting tip will be able to enter between two flat-folded cartons of the low density area. If there is a warped flat-folded carton or a flat-folded carton arranged in diagonal in the low density area, the parting tip may rest on the flat-folded carton and will not be able to fall down between two flat-folded cartons. This will be detected by the sensor, and may abort the dividing of the carton pack. In one example, the dividing of the carton pack is repeated by raising the parting device and the holder foot and by compressing the carton pack again. Thereafter, the holder foot is lowered onto the upper side of the carton pack, and the pusher member is retracted once more, such that a new try is made to divide the pack. If this try does not succeed, an error message may be given. It is also possible to abort the dividing of the carton pack immediately and to give an error message right away. By detecting if the carton pack was divided successfully, it can be ensured that the gripping device will be able to grip a proper stack of cartons. If a gripping device would grip a stack that is not divided in a successful way, one or more cartons may be damaged and the production line may have to stop.

Figure 7:
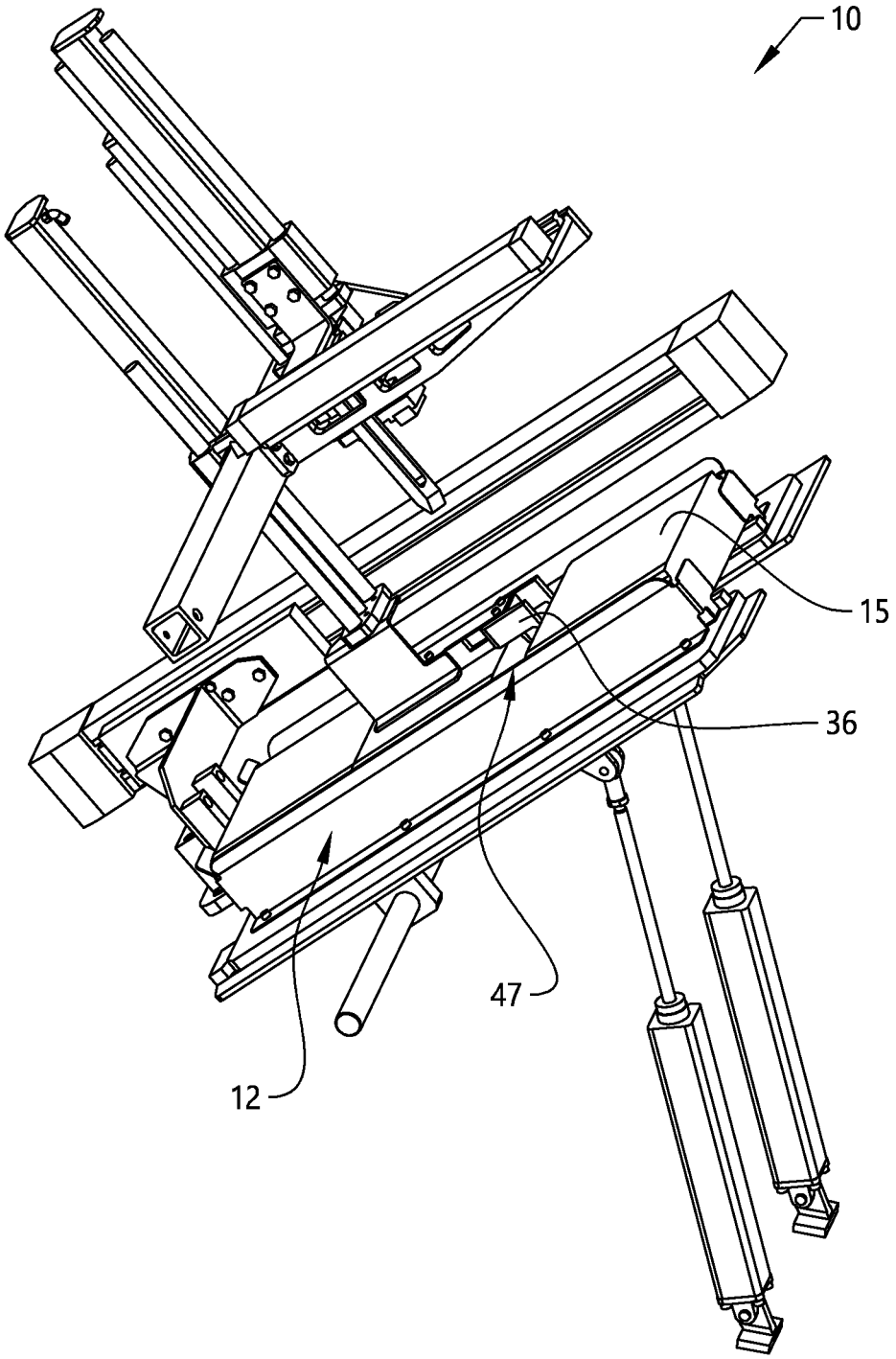
FIG. 7 shows a divider according to the invention with a well-defined gap.

In order to provide a more well-defined gap and to simplify the pick-up of the stack by a gripping device, the distance between two cartons in the low density area can be enlarged. In the shown example, the parting tip 34 is provided with two parting fingers 36. The parting fingers are arranged on each side of the parting tip 34 and are adapted to extend forwards from the parting tip, thereby compressing the first stack some in order to create a well-defined gap. The parting fingers are in this example moved by a linear actuator integrated in the parting arm. By extending the parting fingers forwards, a well-defined gap 47 is created. A parting device 32 with parting fingers 36 extended from the parting tip 34 is shown in FIG. 7.

Figure 8:
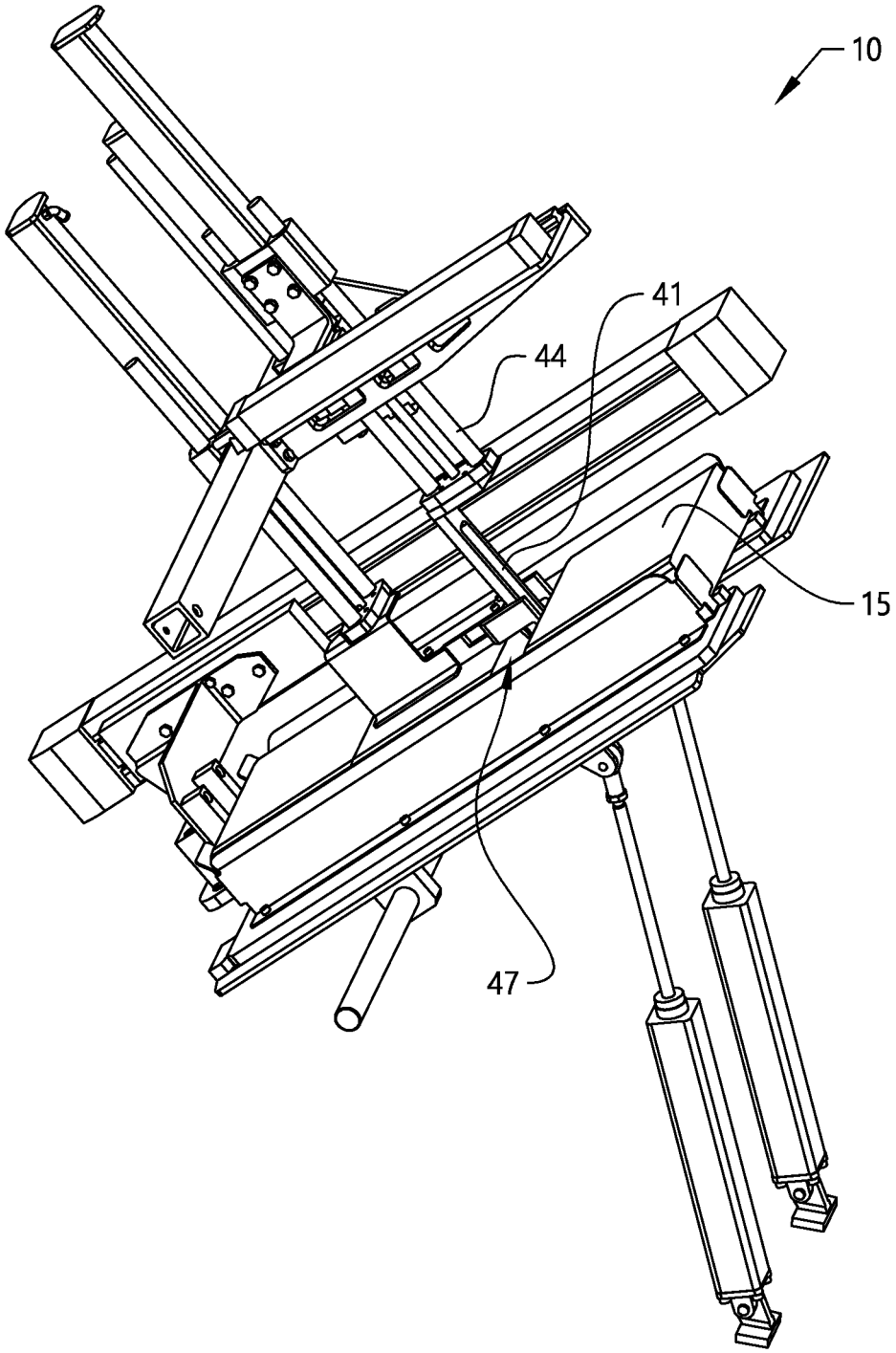
FIG. 8 shows the divider according to the invention with a lowered support finger.
Figure 9:
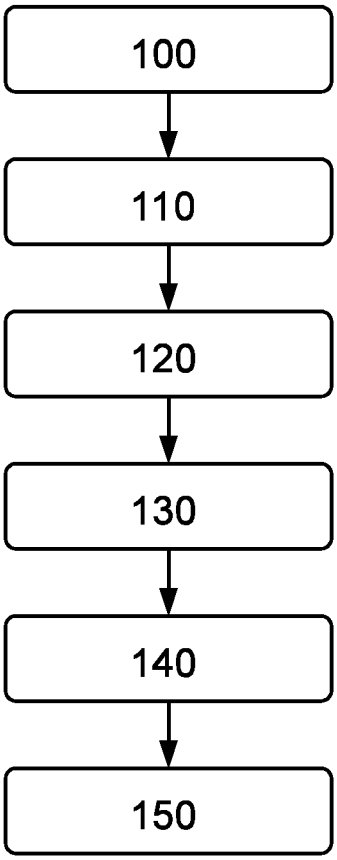
FIG. 9 shows a flowchart of a method for dividing a pack of flat cartons according to the invention.

The shown divider is also provided with a support finger 41. The support finger is mounted on a third linear actuator 44. The support finger is lowered into the gap 47 by lowering the third linear actuator, as can be seen in FIG. 8. When the support finger has been lowered, the parting device 32 is raised to its idle position and the support finger 41 supports the rear of the first carton stack 15 and the front of the remaining carton pack. It is also possible to lower the support finger into the low density area without using the parting device with the parting fingers. This use of parting fingers and/or a support finger may e.g. depend on the design of the gripping device. Lowering the support finger in the gap created by the parting tip and the parting fingers will also prevent damage of the surfaces of the cartons and will ensure that there is no flat-folded carton in the gap.

When the first carton stack 15 has been picked up by a gripping device, the divider will be prepared for dividing a new carton stack. The pusher member will compress the remaining carton pack, the holder foot will be lowered to bear on the upper side of the remaining carton pack, and the pusher member will retract some in order to create a new low density area or even a void adjacent the second stack 16. The parting device and the support finger will be used in the same way as described above. When the second stack 16 of flat-folded cartons has been picked up by the gripping device, the pusher member pushes the third stack 17 forwards to the front of the magazine where it is picked up by the gripping device. The pusher member is then retracted to the idle position and a new pack of flat-folded cartons is placed in the magazine.

In the inventive method for dividing a pack of flat-folded cartons, the pack is divided by using a divider. In step 100, the carton pack is compressed by the pusher member.

In step 110, the carton pack is arranged in an inclined position, e.g. by tilting the magazine holding the carton pack.

In step 120, the holder foot is moved towards the carton pack such that it bears on the carton pack.

In step 130, the pusher member is retracted. This will create a low density area adjacent the flat-folded cartons held by the holder foot. The remaining carton pack will follow the pusher member downwards by gravity which creates the low density area or a void.

In step 140, the parting tip is inserted into the low density area. Parting fingers are extended from the parting tip in order to create a well-defined gap.

In step 150, a support finger is inserted in the well-defined gap created by the parting fingers.

The divider and the method for dividing a pack of flat-folded cartons can be used in any packing plant or other facility where such a divider or method can be used for dividing packs of flat-folded cartons or other flat-folded items. The divider, arrangement or method may also be used with larger flat-folded cartons such as e.g. folded cardboard boxes, or plastic boxes.

The invention is not to be regarded as being limited to the embodiments described above, a number of additional variants and modifications being possible within the scope of the subsequent patent claims.

REFERENCE SIGNS

10: Divider
11: Flat-folded carton
12: Pack of flat-folded cartons
13: Carton plane
14: Stop member
15: First stack of flat-folded cartons
16: Second stack of flat-folded cartons
17: Third stack of flat-folded cartons
18: Holder foot
19: Pusher member
20: Tiltable table
21: Upper side of carton pack
22: Low density area
23: Magazine
32: Parting device
33: Parting arm
34: Parting tip
35: Parting edge
36: Parting finger
39: Bracket
41: Support finger
42: First linear actuator
43: Second linear actuator
44: Third linear actuator
45: Fourth linear actuator
47: Gap

The invention claimed is:

1. A divider for dividing a carton pack of flat-folded cartons into a plurality of stacks of flat-folded cartons, the divider comprising a magazine adapted to hold the carton pack, wherein the magazine includes a stop member, wherein the magazine is arranged in an inclined position, and wherein the divider includes a pusher member and a holder foot, wherein the pusher member is adapted to compress the carton pack between the pusher member and the stop member, that the holder foot is adapted to be lowered to and to bear on a first side of the compressed carton pack, when the carton pack is compressed by the pusher member, thereby holding a first stack of flat-folded cartons and that the pusher member is adapted to release the pressure on the carton pack when the holder foot bears on the first side of the carton pack, thereby creating a low density area adjacent the first carton stack, wherein the divider further includes a parting device having a parting tip adapted to be inserted in the low density area after the holder foot bears on the upper side of the first stack of flat folded cartons and the pressure has been released by the pusher member, and wherein the pusher member is adapted to measure a value from which the length of the carton pack can be estimated.

2. The divider according to claim 1, wherein the pusher member, after the carton pack has been compressed and before the holder foot bears on the carton pack, is adapted to be retracted a predefined amount in dependency of the estimated length of the carton pack.

3. The divider according to claim 1, wherein the parting tip includes a parting finger adapted to extend from the parting tip such that a well-defined gap is created between the first stack and the remaining carton pack.

4. The divider according to claim 1, wherein the parting tip is arranged at a front end of a parting arm, where the parting arm is pivotally suspended at a rear end of the parting arm.

5. The divider according to claim 1, wherein the inclined position of the magazine is between 45 to 60 degrees from the horizontal position.

6. The divider according to claim 1, wherein the holder foot is mounted on a first linear actuator adapted to move the holder foot from a first position spaced apart from the carton pack to a position in which the holder foot bears on the first side of the carton pack.

7. The divider according to claim 1, wherein the parting device is mounted on a second linear actuator adapted to move the parting device from an upper position above the carton pack to a lower position in which the parting tip is inserted into the low density area.

8. The divider according to claim 1, wherein the divider includes a support finger adapted to be inserted between a first stack and the remaining carton pack.

9. A method for dividing a pack of flat-folded cartons using a divider, comprising:

arranging a magazine comprising a carton pack in an inclined position, compressing the carton pack with a pusher member, moving a holder foot from a position spaced apart from the carton pack to a position in which the holder foot bears on a first side of the carton pack when the carton pack is compressed by the pusher member, releasing the pressure of the pusher member by retracting the pusher member, where the flat-folded cartons held by the holder foot constitute a first stack of flat-folded cartons, and where the remaining carton pack held by the pusher member is allowed to move downwards, thereby creating a low density area adjacent the first stack;

inserting a parting tip between two flat-folded cartons in the low density area after the holder foot bears on the upper side of the first stack of flat-folded cartons and after the pressure has been released by the pusher member, and detecting with a sensor if the support finger did enter between two flat-folded cartons in the low density area.

10. A method according to claim 9, further comprising creating a well-defined gap between the first stack and the remaining carton pack by extending a parting finger from the parting tip.

11. A method according to claim 10, further comprising lowering a support finger into the well-defined gap between the first stack and the remaining carton pack.

* * * * *